US006684666B1

(12) United States Patent
Taper

(10) Patent No.: US 6,684,666 B1
(45) Date of Patent: Feb. 3, 2004

(54) OPERATING AND LOCKING MECHANISMS FOR HANDCUFFS

(76) Inventor: William D. Taper, P.O. Box 518, Southern Pines, NC (US) 28388

( * ) Notice: Subject to any disclaimer, the term of this patent is extended or adjusted under 35 U.S.C. 154(b) by 0 days.

(21) Appl. No.: 10/394,668

(22) Filed: Mar. 21, 2003

Related U.S. Application Data

(63) Continuation-in-part of application No. 10/091,272, filed on Mar. 5, 2002, now Pat. No. 6,568,224.

(51) Int. Cl.[7] ..... E05B 75/00
(52) U.S. Cl. ..... 70/16
(58) Field of Search ..... 70/14–19

(56) References Cited

U.S. PATENT DOCUMENTS

| | | | | |
|---|---|---|---|---|
| 1,579,333 | A | 4/1926 | Neal | 70/16 |
| 1,775,727 | A | 9/1930 | Latou | |
| 1,845,511 | A | 2/1932 | Neal | |
| 1,856,427 | A | 5/1932 | Pratt | 70/16 |
| 1,890,748 | A | 12/1932 | Pratt | 70/16 |
| 1,900,242 | A | 3/1933 | Latou | |
| 2,390,885 | A | 12/1945 | Kelley | 70/16 |
| 2,510,294 | A | 6/1950 | Rivolier | 70/16 |
| 3,392,554 | A | 7/1968 | Williamson | 70/16 |
| 3,616,665 | A | 11/1971 | Rosenthal | 70/16 |
| 3,618,345 | A | 11/1971 | Smith | 70/16 |
| 4,287,731 | A | 9/1981 | Kruger | 70/16 |
| 4,314,466 | A | 2/1982 | Harris | 70/16 |
| 4,509,346 | A | 4/1985 | Szczepanek | 70/16 |
| 4,574,600 | A | 3/1986 | Moffett | 70/16 |
| 4,694,666 | A | 9/1987 | Bellingham et al. | 70/16 |
| 5,138,852 | A | 8/1992 | Corcoran | 70/16 |
| 5,598,723 | A | 2/1997 | Ecker et al. | 70/16 |
| 5,697,231 | A | 12/1997 | Tobin et al. | 70/16 |
| 5,797,284 | A | 8/1998 | Lurie | 70/16 |
| 6,311,529 | B1 | 11/2001 | Kang | 70/16 |
| 6,568,224 | B1 * | 5/2003 | Taper et al. | 70/16 |

* cited by examiner

*Primary Examiner*—Suzanne Dino Barrett
(74) *Attorney, Agent, or Firm*—Thomas R. Weaver

(57) ABSTRACT

A set of handcuffs having an improved locking mechanism. The critical element of the locking mechanism is the utilization of a locking gear set that replaces the conventional pawl. The teeth in the locking arm are matched to the locking gear set and are always in constant and full contact with the locking gear set. This invention also uses a cam/cylinder locking device that controls the movement of the locking gear set. In the normal cam position the locking gear set will only turn in one direction, thus enabling the locking arm to close. In the second cam position the locking gear set will not turn in either direction. The cam can be rotated, through the use of a cylindrical key, in either directions. Rotation in one direction will select one of two locking positions. Rotation of the cylindrical key in the opposite direction will free locking gear set to rotate in the opposite direction thus disengaging the locking arm.

10 Claims, 6 Drawing Sheets

OPERATING AND LOCKING MECHANISMS FOR HANDCUFFS

This is a continuation-in-part of U.S. application Ser. No. 10/091,272 filed Mar. 5, 2002, now U.S. Pat. No. 6, 568,224 issued May 27,2003.

BACKGROUND OF THE INVENTION

1. Technical Field of the Invention

This invention broadly relates to locking devices. The invention further relates to locking devices useful to physically restrain the movement by an individual of his or her arms and/or legs. This invention more particularly relates to mechanical restraining devices referred to in the art as "handcuffs." This invention specifically relates to an operating mechanism and to a locking mechanism for a handcuff.

2. Description of the Prior Art and Problems Solved

It is known in the art that a handcuff is an apparatus, usually made of metal, which, when employed, is ordinarily placed around the wrist or ankle of an individual. The apparatus, can be, and usually is, directly connected to another such device by a bridge, such as a chain, a link, or a bar, to thereby form a combination of such devices. The combination is referred to in the art and herein as "handcuffs" or as a "set of handcuffs."

It is also known in the art to place handcuffs upon an individual to render such individual physically ineffective or powerless. Accordingly, handcuffs can be employed, for example, in the field of law enforcement for the purpose of physically restraining an individual from escape and/or to prevent such restrained individual from injuring himself and/or some other person, such as a police officer. It is apparent, then, that a handcuff, or handcuffs, which can be opened and removed by the person being restrained, or by any other unauthorized person, either by force or by device, utterly defeats the purpose of the handcuffs.

As known in the art, a handcuff contains mechanisms which function to permit the apparatus to open and close and also function to prevent the apparatus from opening. The first function is referred to herein as the "operating mechanism." The second function is referred to herein as the "locking mechanism."

An example of a handcuff known in the art which includes an operating and a locking mechanism can be an apparatus comprised of a combination of at least two, and sometimes three, planar, substantially parallel, plates and a movable arm. The plates and movable arm cooperate to produce a ring defined herein as a "restraining space" which can be opened and closed. It is to be understood that the wrist or ankle of the individual to be restrained is placed and confined in the closed restraining space.

The combination of plates is a sandwich structure comprised of two, aligned, exterior plates which cooperate to form a stationary arm and an enclosed interior space. The enclosed interior space is, for convenience, referred to herein as the "machinery space." The machinery space can sometimes be further defined by cavities formed in a third plate positioned between the two exterior plates. The third plate thus separates the exterior plates and provides a cavity or cavities in which the operating and locking mechanisms are positioned.

Each exterior plate is ordinarily a unitary body comprised of a first section, referred to herein as a "cheek plate," and a second section, referred to herein as a "plate arm." The cheek plates serve as the top and bottom covers of the machinery space and as a base to support the operating and locking mechanisms positioned in the machinery space. The plate arms combine to form the stationary arm. The third plate, when employed, is positioned between the cheek plates and can be considered to be a part of the housing for mechanisms positioned in the machinery space.

Each plate arm, which extends beyond the cheek plate to form one side of the stationary arm, is a rigid, curvilinear, i.e., a "C-shaped," member which terminates at an end adapted for hinged attachment to the movable arm. The stationary arm, which as stated, is formed by the combination of the aligned, curvilinear, plate arms, is referred to as such to distinguish the combination of plate arms from the movable arm of the handcuff. The combination of the terminal ends of each plate arm is referred to as the hinge end of the stationary arm.

The movable arm of a handcuff, which has been variously referred to as a curved locking arm or as a swing arm, is also a rigid, curvilinear member having a pivot end and a free end. The pivot end of the swing arm is positioned between the terminal ends of each plate arm and is rotatably connected to the hinge end of the stationary arm. The free end of the swing arm is equipped with teeth adapted to engage, that is, contact and intermesh with, opposing teeth mounted within the machinery space.

Accordingly, in operation, the pivot end of the swing arm and the hinge end of the stationary arm cooperate to permit the free end of the swing arm to rotate into at least a portion of the machinery space wherein the teeth on the free end of the swing arm engage teeth mounted within the machinery space to thereby form and close the restraining space. In handcuffs known in the prior art the restraining space is opened by causing the respective teeth to disengage followed by rotating the swing arm out of the machinery space.

From the above description it is evident that a handcuff functionally comprises a restraining space and a machinery space. The prior art of particular interest herein is the specific operating and locking mechanisms employed in the machinery space.

The operating mechanism of a prior art handcuff is embodied in a substantially linear member enclosed in the machinery space which features a plurality of teeth mounted on one side thereof which are adapted to engage teeth on the swing arm. The prior art operating mechanism is hinged at one end and biased to urge the teeth on the member into engagement with the teeth on the swing arm. The mechanism can be thus characterized as a hinged pawl situated within the machinery space of the handcuff. The swing arm must enter the machinery space to close the restraining space. Accordingly, the swing arm is rotated into the machinery space with force sufficient to overcome the resistance of the biasing source to cause the pawl to rotate about the hinge. The result of this action is to raise the teeth on the pawl out of engagement with the teeth on the swing arm. The operating mechanism of the prior art thus employs a reciprocating action wherein the teeth on the pawl and the teeth on the swing arm are continually alternating between an engaged and a disengaged condition as the swing arm is rotated into the machinery space.

A prior art handcuff features a first operating position and a second operating position. The first operating position is referred to as the "ready-to-lock" position. In this position, the swing arm is permitted to swing inwardly into the machinery space of the handcuff to close and reduce the area of the restraining space, to thereby tighten the restraint around the wrist or ankle of an individual, but the handcuff is not permitted to be loosened or opened because the teeth of the pawl are designed to permit inward, but not outward, movement of the teeth on the swing arm. It is believed that the shape of the teeth of the pawl and the teeth of the swing arm combine to prevent the swing arm from rotating out of the machinery space of the handcuff.

The second operating position, referred to as the "double locked" or secondary locking position, employs, as the locking mechanism, a movable physical barrier, such as a rod or a bar, positioned within the machinery space of the handcuff to prevent the pawl from performing the mentioned reciprocating action and, therefor, prevents the swing arm from rotating around the hinge end of the stationary arm. In the second operating position, the swing arm cannot be moved in either direction (i.e., inwardly into or outwardly out of the machinery space of the handcuff), because the pawl teeth are caused to remain in continuous contact with the teeth of the swing arm by the locking mechanism to prevent any movement of the swing arm. In this regard, the reciprocating movement of the pawl to disengage the pawl teeth is prevented by the mentioned rod or bar positioned between the reciprocating, i.e., free, end of the pawl and the inner surfaces of the cheek plates of the handcuff.

As mentioned, prior art handcuffs, and similar such restraints, employ a combination locking and operating mechanism featuring a swing arm having ratchet teeth in operable combination with the teeth of a pawl. These mechanisms are not secure because they can be opened by force, for example by jimmying and jarring. There is, thus, a need for a locking and an operating mechanism which resists being unlocked by leverage, impact and rotational forces which employ tools, such as lock picks and shims.

It is well known that handcuffs and restraints employing the prior art ratchet and pawl mechanism can be forcibly opened by use of a thin flat item, such as a small metal ruler or by a plastic credit card. In this regard, and as previously mentioned, the prior art ratchet and pawl operating and locking mechanism, in the very act of contacting and intermeshing the teeth of the pawl with the teeth of the swing arm, inherently involves the teeth on the pawl and the teeth on the swing arm continually alternating between an engaged and a disengaged condition. This inherent action can be exploited in a technique called "jimmying," wherein a shim, such as a thin flat item, is forced between the teeth of the swing arm and the teeth of the pawl to overcome the biasing source and raise the pawl by an amount sufficient to interrupt contact between the teeth of the pawl and the ratchet teeth to enable the outward movement of the swing arm to thereby open the restraining space.

It is further known that the above described prior art ratchet and pawl handcuffs and restraining devices employ a simple rod or bar, which, when properly positioned, prevents the pawl from being raised by a shim. Positioning the rod or bar can be accomplished by inserting the pin end of the handcuff key into a small hole in the side of the handcuff to move the bar. The locking mechanism can be defeated by striking the handcuff on a solid object, such as a rock or pavement, to jar the bar out of position. Once the secondary locking mechanism has been jarred out of position, the handcuffs or restraints can then be jimmied as described above.

A prior art handcuff key is little more than a piece of metal which, upon rotation within the key way, positions a cam to cause or prevent vertical movement of the pawl. The rotation of the key about its longitudinal axis requires so little torque to move the cam that an operable key can be formed from a paper clip.

Furthermore, in a technique called "picking," a paper clip, or other bendable yet sturdy element, can be modified and used along with other small pieces of wire to perform the same function as the key.

In view of the problems involving the operating and locking mechanisms of handcuffs of the prior art, it is an object of this invention to provide a handcuff having an operating mechanism which is at all times in full contact and intermeshed with teeth on the swing arm when the handcuff is being either opened or closed. Another object of this invention is to provide a handcuff having a locking mechanism which can permit or prevent movement of the operating mechanism. These and other objects, advantages and features provided by this invention will become apparent to those persons skilled in the art from a consideration of the following description and drawings which describe the apparatus of this invention and the manner and process of making and using the same.

THE INVENTION

Summary of the Invention.

This invention provides an apparatus useful as a handcuff. The apparatus is comprised of a housing having an operating and a locking mechanism enclosed therein, wherein the housing is comprised of at least two, substantially identically shaped, opposed, substantially parallel, plates, and a swing arm. Each plate is a unitary body divided into a first section called a "cheek plate," and a second section called a "plate arm." The plates are spaced apart to provide a machinery space between the cheek plates and a curvilinear stationary arm defined by the plate arms. The space between the terminal ends of the plate arms is referred to as the hinge end of the stationary arm.

The swing arm is an elongated curvilinear body having a pivot end and a free end. The pivot end of the swing arm is rotatably connected to the hinge end of the stationary arm. The swing arm extends in an arc toward the machinery space from the hinge end of the stationary arm. The free end of the swing arm is equipped with teeth adapted to engage, that is, contact and intermesh with, opposing teeth mounted within the machinery space.

The swing arm, the stationary arm, and the inner edges of the opposed cheek plates cooperate to form the restraining space of the handcuff when the free end of the swing arm is rotated into and engaged with teeth mounted in the machinery space.

The operating mechanism of this invention is housed in the machinery space. In one embodiment, the operating mechanism of this invention can be a toothed wheel, that is, a gear, whose teeth engage the teeth mounted on the swing arm. In another embodiment, the operating mechanism of this invention can be comprised of two gears, each of whose teeth can simultaneously engage the teeth mounted on the swing arm. In still another embodiment, the operating mechanism of this invention can be comprised of an array of three intermeshing gears having two gears, referred to herein as "working gears," whose teeth can simultaneously engage the teeth mounted on the swing arm, and a third gear, referred to herein as an "idler gear," whose teeth are continually and simultaneously engaged with the teeth on the two working gears. In still another embodiment, the operating mechanism can be comprised of a single working gear and an idler gear.

When the handcuff is being opened or closed, that is, when the restraining space is being opened or closed, teeth mounted on the swing arm are always in contact with teeth on at least one of the working gears. Thus, gear teeth engage teeth of the swing arm: when the swing arm is in the closed position and not moving; when the swing arm is being rotated into machinery space to place the handcuff into the closed position; and when the swing arm is being rotated out of the machinery space to place the handcuff in an open position.

Any working gear of the operating mechanism having teeth engaged, that is, in contact and intermeshed, with teeth on the swing arm must rotate to enable any rotational movement of the swing arm. This invention, accordingly, further provides a multi-function locking mechanism which controls the rotation of the gears. The locking mechanism of this invention is housed in the machinery space in a location separate from the operating mechanism.

In a first locking position, referred to herein as the "closing position," the locking mechanism is adjusted to permit rotation of the gears in one direction to permit closing rotation of the swing arm, and to prevent rotation of the gears in the opposite direction to prevent opening rotation of the swing arm. In a second locking position, referred to herein as the "locked position," the locking mechanism is adjusted to prevent any rotation of the gears in any direction to prevent any rotation of the swing arm in any direction. In a third locking position, referred to herein as the "free position," the locking mechanism is adjusted to permit rotation of the gears in any direction to permit rotation of the swing arm in any direction.

One specific embodiment of this invention comprises an array of three intermeshing gears in the operating mechanism consisting of two working gears and one idler gear wherein a control pin directly contacts a working gear. Another specific embodiment of this invention also comprises an array of three intermeshing gears in the operating mechanism consisting of two working gears and one idler gear wherein a control pin directly contacts the idler gear. In terms of operation, the two embodiments operate in the same way, that is, rotation of the gears is controlled by a pin in direct contact with a gear.

In view of the above, it will be appreciated that the operating mechanism of this invention is broadly comprised of a working gear and a swing arm. In this regard, the working gear is rotatably mounted on a gear axle which is perpendicularly attached to a planar base, and the swing arm is rotatably mounted on a swing arm axle which is also perpendicularly attached to the planar base a fixed distance from the gear axle.

The working gear is a wheel having a first radius with teeth mounted on the outer edge of the wheel which rotates around the gear axle in a plane parallel to the plane of the planar base.

The swing arm is a curvilinear member having a first end and a second end with teeth mounted on the outer edge of the first end. The distance from the outer edge of the first end of the swing arm to the swing arm axle is the second radius. The swing arm rotates around the swing arm axle in a plane parallel to the planar base.

The mentioned fixed distance is substantially equal to the sum of the lengths of the first radius and the second radius. Accordingly, the teeth on the working gear and the teeth on the swing arm contact and intermesh each with the other upon rotation of the working gear around the gear axle and rotation of the swing arm around the swing arm axle. The teeth on the working gear and the teeth on the swing arm are thus adapted to intermesh upon contact., The operating mechanism of this invention can further include, in one embodiment, a linear rod slidably mounted on, and parallel to, the planar base in a position opposed to the working gear, and preferably perpendicular to the gear axle; or, in another embodiment, a linear rod slidably mounted on, and parallel to, the planar base in a position opposed to the idler gear and preferably perpendicular to the idler gear axle. The linear rod has a proximal end, a distal end and a biasing means to urge the proximal end of the rod into contact with the teeth on the working gear or the idler gear as the case may be. The proximal end of the rod is adapted to contact the teeth on the designated gear to permit rotation of the gear around its axle in one rotational direction while preventing rotation of the gear around its axle in the opposite rotational direction.

The operating mechanism of this invention can be further controlled by a locking mechanism comprised of a cam in operable combination with a cam lever, which is rigidly attached to the linear rod at a point intermediate the proximal end and the distal end of the linear rod.

The cam, referred to herein as a yoke, is a plate having an axle end and a forked end linearly spaced apart from the axle end. The axle end of the yoke is closed and rotatably mounted on a yoke axle. The forked end of the yoke is open having a first leg on one side of the opening and a second leg on the opposite side of the opening side wherein the second leg is spaced apart from and, preferably, parallel to the first leg.

The yoke axle is perpendicularly fixed to the planar base. The axle end of the yoke is rotatably mounted on the yoke axle so that the cam lever is situated between the first leg and the second leg of the forked end of the yoke. The yoke rotates around the yoke axle in a plane parallel to the planar base.

Rotation of the yoke around the yoke axle causes contact between the cam lever and one of the first leg and second leg which, in consequence, controls rotation of the working gear and swing arm.

The preceding description has been generally limited to a handcuff comprised of an operating mechanism consisting of one working gear, a swing arm and a linear rod. The operating mechanism can be further comprised of an idler gear and a second working gear. In this regard the operating mechanism can include a combination of two working gears, a combination of one working gear and the idler gear, or a combination of two working gears and an idler gear. The linear rod can be positioned to contact any of the gears.

The locking mechanism can be further comprised of a means for rotating the yoke on the yoke axle and detent means for maintaining the position of the yoke with respect to the cam lever.

It is believed that the specific locations of the operating and locking mechanisms of this invention within separate machinery spaces as well as structural features of the swing arm and the machinery spaces, serve to prevent the insertion of any object, such as a shim, between the swing arm teeth and the gear teeth and/or between the locking mechanism and the gear teeth. Even if any object is inserted between any of the various teeth and mechanisms, then, It is further believed, that the shim will become wedged in the teeth and or gears which will operate to prevent any rotation of the gears and thus prevent any rotation of the swing arm.

It is clear that the operating mechanism of the present invention replaces the pawl of the prior art with a gear or gears, which are constantly, and fully engaged with the teeth of the swing arm. The operating gears cannot be jimmied open by the insertion of a metal or plastic shim. Additionally, the locking mechanism utilizes a yoke that is positioned and formed to make it difficult to pick by anyone.

DESCRIPTION OF THE PREFERRED EMBODIMENTS

Figure 1A:
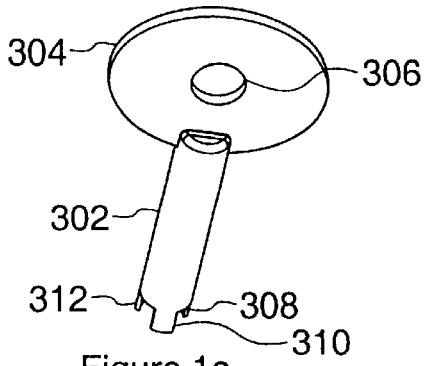
FIG. 1*a* is a three dimensional representation of a key employed to manipulate the locking mechanism of the present invention.
Figure 1:
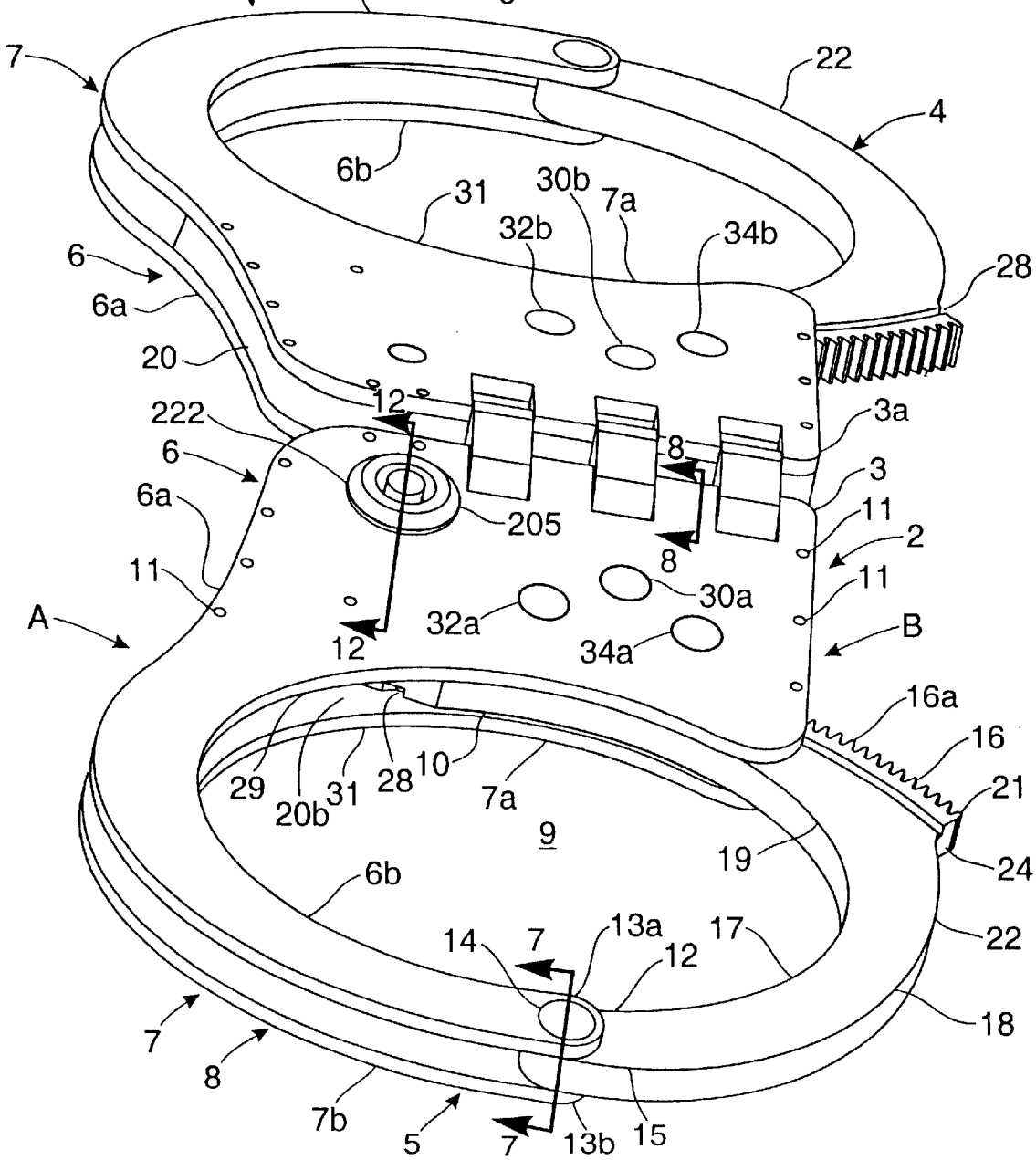
FIG. 1 is a three dimensional representation of a set of handcuffs of the present invention.

This invention provides an apparatus useful as a handcuff. The apparatus is comprised of a housing having an operating and a locking mechanism enclosed therein, wherein the housing, as shown in FIG. 1, is comprised of at least two, substantially identically shaped, opposed, substantially parallel, plates, 6 and 7, and a swing arm, 22. Each plate is a unitary body having an inside surface, an outside surface, an arm side, A, and an open side, B. Each plate, such as plate 6, for convenience of reference herein, is divided into a first section, 6*a*, referred to as a "cheek plate," and a second section, 6*b*, referred to as a "plate arm." A plate arm is a narrow, elongated, curvilinear part of the plate which extends in an arc from the arm side of the plate to a terminal end on the open side of the plate. The plates are spaced apart to provide a machinery space between the opposed inside surfaces of each cheek plate and a curvilinear stationary arm defined by the spaced, opposed plate arms. The space between the terminal ends of the plate arms is referred to as the hinge end of the stationary arm.

The swing arm, like the stationary arm, is also a narrow, elongated curvilinear body having a pivot end and a free end. The pivot end of the swing arm is positioned between the terminal ends of the plate arms and rotatably connected to the hinge end of the stationary arm. The swing arm extends in an arc toward the open side of each plate from the hinge end of the stationary arm to the free end of the swing arm. The free end of the swing arm is equipped with teeth adapted to engage, that is, contact and intermesh with, opposing teeth mounted within the machinery space.

The swing arm, the stationary arm, and the inner edges of the opposed cheek plates cooperate to form the restraining space of the handcuff when the free end of the swing arm is rotated into and engaged with teeth mounted in the machinery space.

Figure 2:
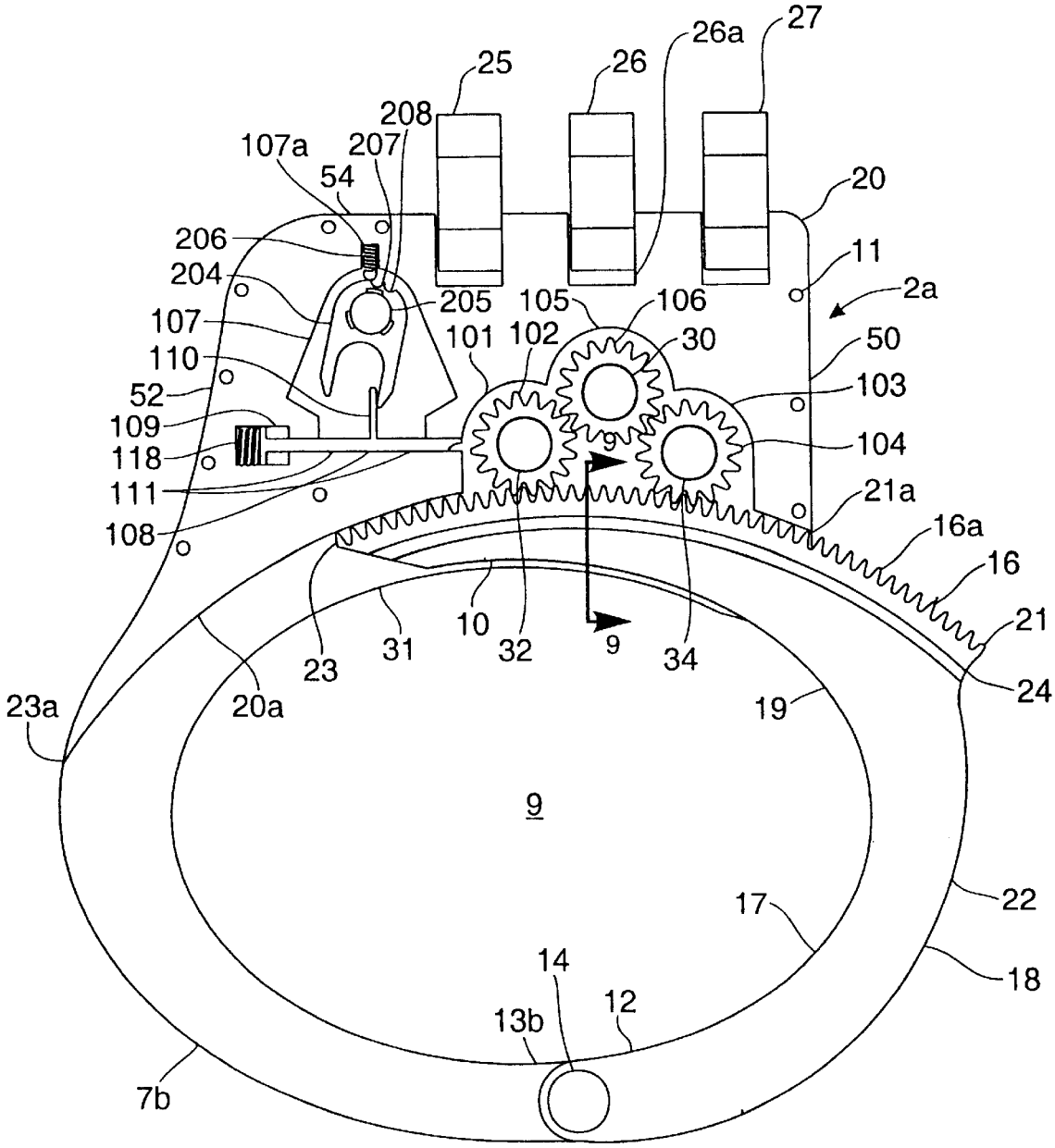
FIG. 2 is a plan view of a handcuff of the present invention having an exterior plate removed to reveal the swing arm, the interior plate, the machinery spaces, the operating mechanism and the locking mechanism configured in the free position.
Figure 3:
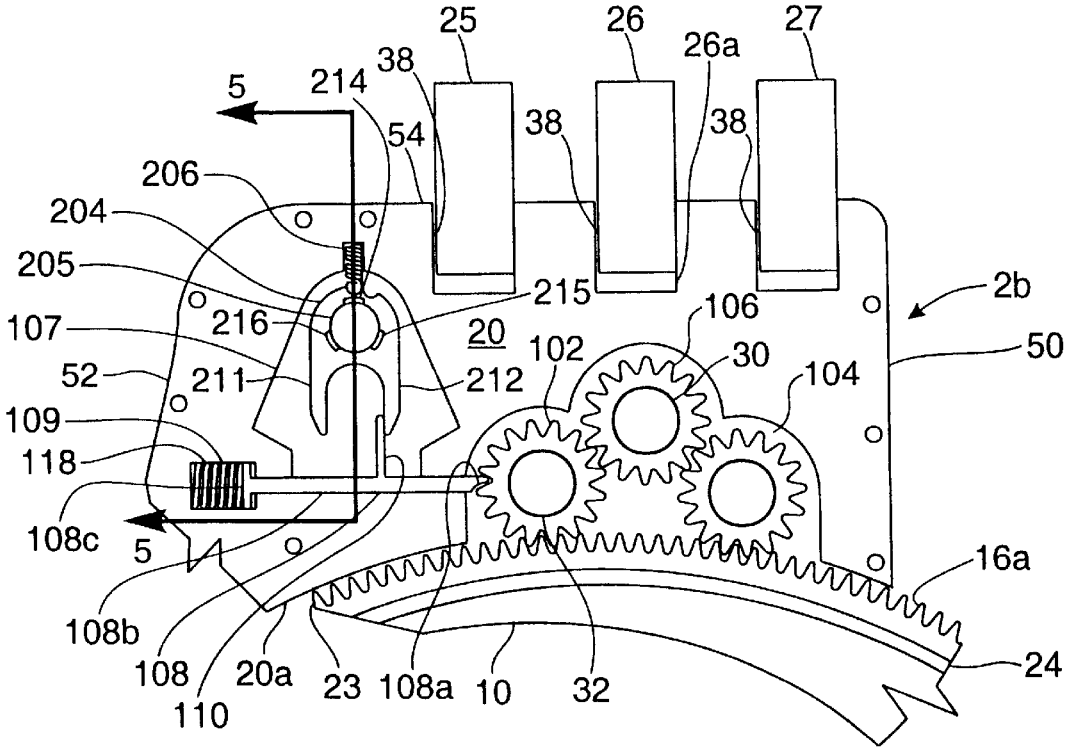
FIG. 3 is a modified view of FIG. 2 showing the locking mechanism configured in the closing position.
Figure 4:
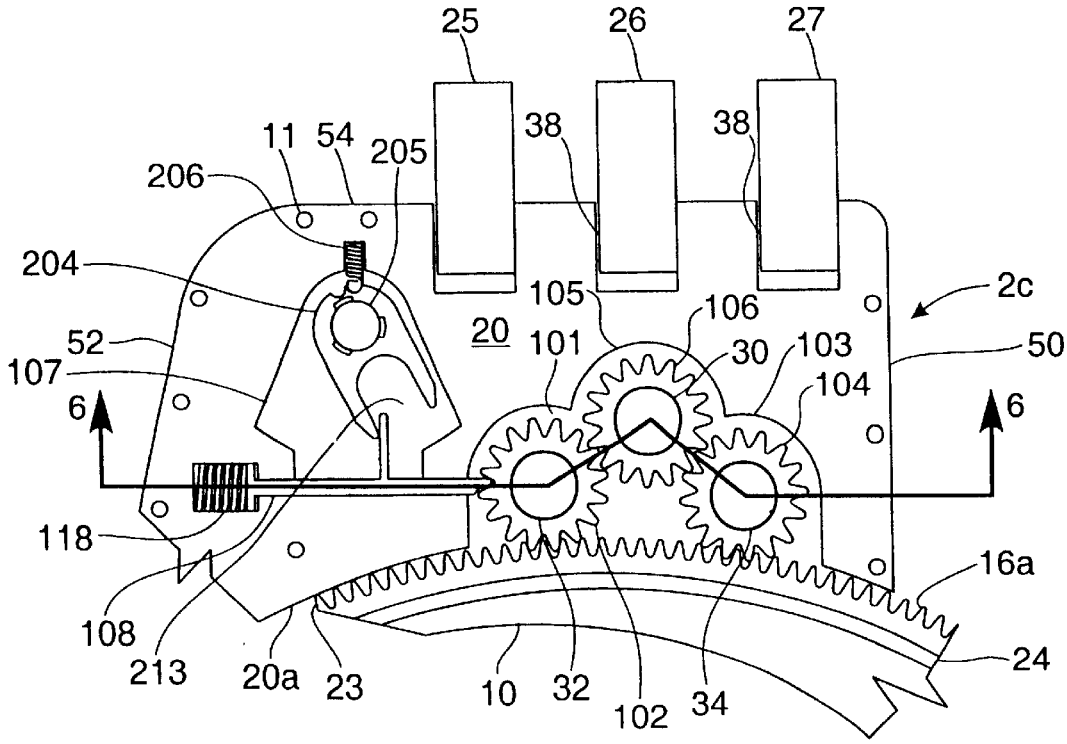
FIG. 4 is a modified view of FIG. 2 showing the locking mechanism configured in the locked position.
Figure 5:
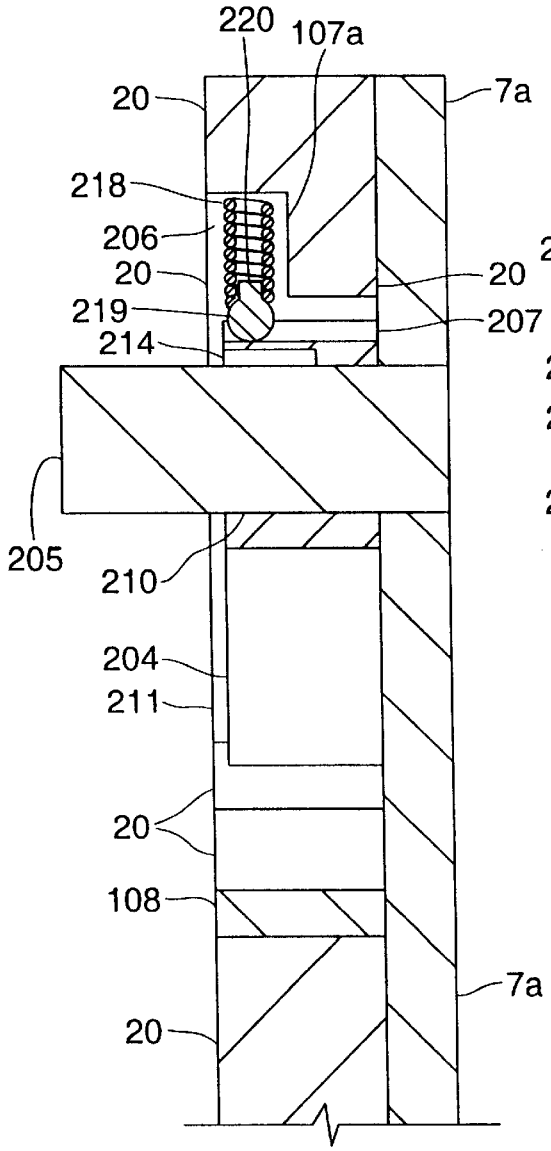
FIG. 5 is a partial sectional view taken in the direction of cut line 5—5 of FIG. 3 showing the yoke, yoke axle and detent assembly of the locking mechanism and the control pin of the operating mechanism.

The operating mechanism of this invention is housed in the machinery space between the opposed cheek plates. In one embodiment, the operating mechanism of this invention can be a toothed wheel, that is, a gear, whose teeth engage the teeth mounted on the swing arm. In another embodiment, the operating mechanism of this invention can be comprised of two gears, each of whose teeth can simultaneously engage the teeth mounted on the swing arm. In still another embodiment, the operating mechanism of this invention, as shown in FIGS. 2–4, can be comprised of an array of three intermeshing gears having two gears, referred to herein as "working gears," whose teeth can simultaneously engage the teeth mounted on the swing arm, and a third gear, referred to herein as an "idler gear," whose teeth are continually and simultaneously engaged with the teeth on the two working gears. In still another embodiment, the operating mechanism can be comprised of a single working gear and an idler gear. When the handcuff is being opened or closed, that is, when the restraining space is being opened or closed, teeth mounted on the swing arm are always in contact with teeth on at least one of the working gears. Thus, gear teeth engage teeth of the swing arm when the swing arm is in the closed position and not moving, as shown in FIG. 4, when the swing arm is being rotated toward the open side of the plates to place the handcuff into the closed position, as shown in FIG. 3, and when the swing arm is being rotated away from the open side of the plates to place the handcuff in an open position, as shown in FIG. 2.

Any working gear of the operating mechanism having teeth engaged, that is, in contact and intermeshed, with teeth on the swing arm must rotate to enable any rotational movement of the swing arm. This invention, accordingly, further provides a multi-function locking mechanism which controls the rotation of the gears. The locking mechanism of this invention is housed in the machinery space between the opposed cheek plates in a location separate from the operating mechanism.

In a first locking position, shown in FIG. 3, referred to herein as the "closing position," the locking mechanism is positioned to permit rotation of the gears in one direction to thereby permit closing rotation of the swing arm, and to prevent rotation of the gears in the opposite direction to thereby prevent opening rotation of the swing arm. In a second locking position, shown in FIG. 4, referred to herein as the "locked position," the locking mechanism is positioned to prevent any rotation of the gears in any direction to thereby prevent any rotation of the swing arm in any direction. In a third locking position, shown in FIG. 2, referred to herein as the "free position," the locking mechanism is positioned to permit rotation of the gears in any direction to thereby permit rotation of the swing arm in any direction.

Figure 13:
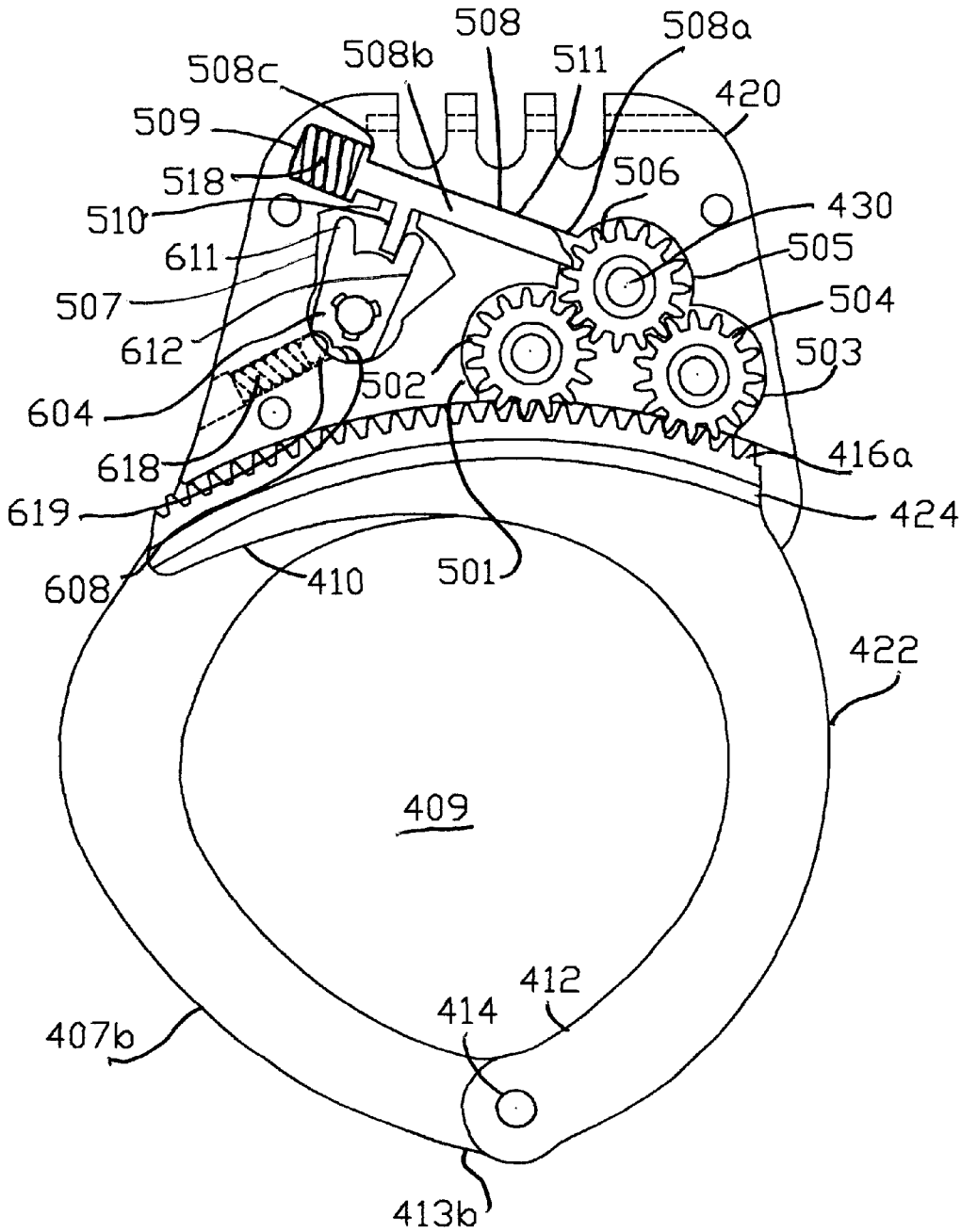
FIG. 13 is a plan view of a handcuff of the present invention having an exterior plate removed to reveal the swing arm, the interior plate, the machinery spaces, the operating mechanism and the locking mechanism configured in the closing position.

FIGS. 2–4 illustrate one specific embodiment of this invention featuring an array of three intermeshing gears in the operating mechanism consisting of two working gears and one idler gear wherein a control pin directly contacts a working gear. In another embodiment of this invention, FIG. 13 illustrates another specific embodiment of this invention also featuring an array of three intermeshing gears in the operating mechanism consisting of two working gears and one idler gear, but wherein the control pin directly contacts the idler gear. In terms of operation, FIG. 13 is comparable to FIG. 3. Thus, in a first locking position, shown in FIG. 13, referred to herein as the "closing position," the locking mechanism is positioned to permit rotation of the gears in one direction to thereby permit closing rotation of the swing arm, and to prevent rotation of the gears in the opposite direction to thereby prevent opening rotation of the swing arm.

Having, thus, generally alluded to the apparatus as a whole, it will be appreciated that the operating mechanism of this invention is broadly comprised of a first working gear and a swing arm. In this regard, the first working gear is rotatably mounted on a first gear axle which is perpendicularly attached to a planar base, and the swing arm is rotatably mounted on a swing arm axle which is also perpendicularly attached to the planar base a first fixed distance from the first gear axle.

The first working gear is a wheel having a first radius. Teeth are mounted on the outer edge of the wheel which rotates around the first gear axle in a plane parallel to the plane of the planar base.

The swing arm is a curvilinear member having a first end and a second end. Teeth are mounted on the outer edge of the first end. The distance from the outer edge of the first end of the swing arm to the swing arm axle is referred to as the second radius. The swing arm rotates around the swing arm axle in a plane parallel to the planar base.

The mentioned first fixed distance is substantially equal to the sum of the lengths of the first radius and the second radius. Accordingly, the teeth on the first working gear and the teeth on the swing arm contact and intermesh each with the other upon rotation of the first working gear around the first gear axle and rotation of the swing arm around the swing arm axle. The teeth on the first working gear and the teeth on the swing arm are thus adapted to intermesh upon contact.

The operating mechanism of this invention, as mentioned above, can further include, in one embodiment, a control pin comprising a linear rod slidably mounted on, and parallel to, the fixed planar base in a position opposed to the first working gear, and preferably perpendicular to the first axle; or, in another embodiment, a control pin comprising a linear rod slidably mounted on, and parallel to, the fixed planar base in a position opposed to the idler gear and preferably perpendicular to the idler gear axle. The linear rod has a proximal end, a distal end and a biasing means, such as spring, abutting the distal end of the rod to urge the proximal end of the rod into contact with the teeth on the first working gear or the idler gear as the case may be. The proximal end of the rod is adapted to contact the teeth on the designated gear to permit rotation of the gear around its axle in one rotational direction while preventing rotation of the gear around its axle in the opposite rotational direction.

The operating mechanism of this invention can be further controlled by a locking mechanism which converts rotational motion to linear motion. The locking mechanism is thus comprised of a cam in operable combination with a cam follower, referred to herein as a cam lever, which is perpendicularly and rigidly attached to the mentioned linear rod of the control pin at a point intermediate the proximal end and the distal end of the linear rod.

The cam is a plate in the shape of a yoke having a hole in one end, referred to as the axle end, and a forked end linearly spaced apart from the axle end. The cam is, accordingly, referred to herein as a yoke. The axle end of the yoke is closed and rotatably mounted on a yoke axle. The forked end of the yoke is open having a first leg on one side of the opening and a second leg on the opposite side of the opening side wherein the second leg is spaced apart from and, preferably, parallel to the first leg.

The yoke axle is perpendicularly fixed to the planar base. The axle end of the yoke is rotatably mounted on the yoke axle so that the cam lever on the control pin is situated between the first leg and the second leg of the forked end of the yoke. The yoke rotates around the yoke axle in a plane parallel to the planar base.

As seen in FIG. 2, rotation of the yoke around the yoke axle in one rotational direction causes contact between the cam lever and the inside surface of the first leg to thereby linearly urge the rod against the biasing means at the distal end of the rod and permit rotation of the gears in any rotational direction. As seen in FIG. 4, rotation of the yoke around the yoke axle in the opposite rotational direction causes contact between the cam lever and the inside surface of the second leg to thereby linearly urge the proximal end of the rod against the teeth of the first working gear and prevent rotation of the gears in any rotational direction. As seen in FIGS. 3 and 13, configuring the yoke in a neutral position permits contact between the cam lever and the inside surface of the first leg, but does not urge the rod against the biasing means at the distal end of the rod, thus permitting closing rotation of the swing arm, but preventing opening rotation of the swing arm.

The operating mechanism of this invention can be further comprised of an idler gear, a wheel having a third radius and teeth mounted on the outer edge the wheel, wherein the teeth on the idler gear and the teeth on the first working gear are in contact each with the other. The teeth on the idler gear and the teeth on the first working gear are adapted to intermesh upon contact.

The idler gear is rotatably mounted on the idler gear axle which is perpendicularly attached to, and positioned on, the planar base a second fixed distance from the first gear axle, and a third fixed distance from the swing arm axle. The idler gear rotates around the idler gear axle in a plane parallel to the plane of the planar base.

The operating mechanism of this invention can be further comprised of a second gear axle and a second working gear wherein the second gear axle is perpendicularly attached to and positioned on the planar base a fourth fixed distance from the first gear axle, a fifth fixed distance from the swing arm axle and a sixth fixed distance from the idler gear axle. The second working gear is rotatably mounted on the second gear axle to enable the second working gear to rotate around the second gear axle in a plane parallel to the plane of the base. The second working gear is a wheel having a fourth radius and teeth mounted on the outer edge thereof.

The fifth fixed distance is substantially equal to the sum of the lengths of the second radius and the fourth radius whereby the teeth on the second working gear and the teeth on the swing arm are in contact and intermesh each with the other upon rotation of the second working gear around the second gear axle and rotation of the swing arm around the swing arm axle. The teeth on the second working gear and the teeth on the swing arm are thus adapted to intermesh upon contact. In a preferred embodiment, the radius of the second working gear, that is, the fourth radius, is equal to the radius of the first working gear, that is, the first radius, and the fifth fixed distance is equal to the first fixed distance.

It is preferred that the teeth on the idler gear and the teeth on the second working gear also contact each other. Accordingly, the teeth on the idler gear and the teeth on the second working gear are adapted to intermesh upon contact and the fourth radius is equal to the third radius. It is also preferred that the third radius is equal to the first radius.

The locking mechanism of this invention can be, and is preferably, further comprised of a means for rotating the yoke on the yoke axle and detent means for maintaining the position of the yoke with respect to the cam lever in either the previously mentioned closing position or the previously mentioned locked position.

Refer now to the Figures, and particularly to FIGS. 1–4 and 13. Every detail of FIG. 13 is not described, but notice that the reference numerals employed in FIG. 13 are 400 numbers greater than the numerals shown in FIGS. 1–12. Thus, for example, reference numeral 10 in FIG. 3 corresponds to reference numeral 410 in FIG. 13. Reference is made to a numeral in FIG. 13 only if clarification is believed to be served by such reference.

Thus, there is shown a set of handcuffs 1 broadly comprised of first handcuff 2 and second handcuff 4 positioned end-to-end and flexibly connected together. In this regard, proximal end 3 of handcuff 2 is spaced apart from and flexibly connected to proximal end 3*a* of handcuff 4 by coupling links 25, 26 and 27. Handcuff 2 and handcuff 4 can be identical in construction and operation and are shown as such in FIG. 1, accordingly, the following description of handcuff 2 is fully applicable to handcuff 4. Therefor, only handcuff 2 is described in detail. Reference is made to handcuff 4, or any of its elements, only if clarification is believed to be served by such reference.

Handcuff 2 is an apparatus comprised of the combination of planar top plate 6, which is aligned with and parallel to, planar bottom plate and 7, housing block 20, containing the operating and locking mechanisms of this invention, and curvilinear swing arm 22. Plates 6 and 7 function as a base for support of housing block 20 and swing arm 22. Plates 6 and 7 are identical in shape, are opposed, are in alignment and are spaced apart by, and rigidly attached to, housing block 20 by a plurality of rivets 11. Each of plates 6 and 7 includes top cheek plate 6*a*, bottom cheek plate 7*a*, top plate arm 6*b* and bottom plate arm 7*b*. Plate arms 6*b* and 7*b* combine to form stationary arm 8 which broadly operates with swing arm 22 to form closed ring 9 having an open center. More specifically, stationary arm 8 and swing arm 22 each have opposed concave sides which, together with the concave interior edges of cheek plates 6*a* and 7*a* cooperate to form closed ring 9 which is adapted to be fitted around an oval or circular object, such as the wrist or ankle of an individual. The open center of closed ring 9 is the restraining space of handcuff 2.

Housing block 20 is positioned in proximal end 3 of handcuff 2 between cheek plates 6*a* and 7*a*. Pivot pin 14 is positioned in distal end 5 of handcuff 2 between terminal ends 13*a* and 13*b* of plate arms 6*b* and 7*b*. Plate arms 6*b* and 7*b* combine to form stationary arm 8 which serves in a transition capacity between, and rigidly connects, proximal end 3 to distal end 5. Pin end 12 of swing arm 22 is rotatably attached to pivot pin 14.

Proximal end 3 of handcuff 2 is a closed body formed by the combination of cheek plates 6*a* and 7*a* and housing block 20. Housing block 20 contains cavities 107, 109, 111, 101, 103 and 105 which enclose the locking mechanism and the operating mechanism of this invention. The operating and locking mechanisms are described below. It is to be understood that FIGS. 2–6 and 9 deliberately do not show plate 6 of handcuff 2 to enable the convenient description and visualization of the contents of housing block 20. Also, since handcuff 2 and handcuff 4 are identical, the reference numerals employed in this description apply with equal facility to each of plates 6 and 7 unless a difference in reference numeral identification for otherwise comparable parts is believed to be desirable.

Figure 7:
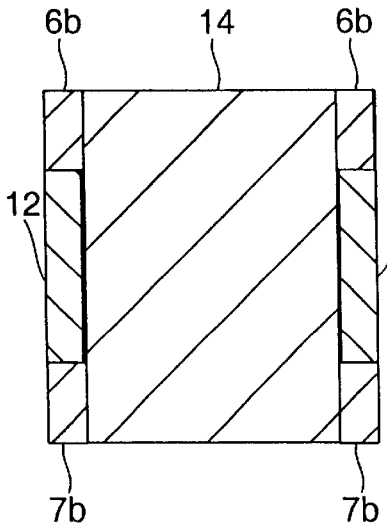
FIG. 7 is a sectional view taken in the direction of cut line 7—7 of FIG. 1 showing the connection between the pivot end of the swing arm and the hinge end of the stationary arm.

Swing arm 22 and stationary arm 8 are joined in distal end 5 of handcuff 2. As is more clearly shown in FIG. 2, stationary arm 8, comprised of the combination of plate arms 6*b* and 7*b*, is in the shape of the letter "C" wherein each of plate arms 6*b* and 7*b* is a curvilinear structure extending from the arm sides "A" of cheek plates 6*a* and 7*a* in proximal end 3 to terminal ends 13*a* and 13*b* in distal end 5. It is to be understood that terminal ends 13*a* and 13*b* combine to form the hinge end of stationary arm 8. As illustrated in FIG. 7, terminal end 13*b* of plate arm 7*b* and terminal end 13*a* of plate arm 6*b* are each equipped with a hole. The holes are in alignment.

Swing arm 22 is a single curvilinear member comprised of free end 10 and pin end 12. Pin end 12 is equipped with a hole. Pin end 12 of swing arm 22 is adapted for insertion between the hinge end of stationary arm 8. Pivot pin 14 press fits into the holes in terminal ends 13*a* and 13*b* of plate arms 6*b* and 7*b* so that it will not move. However, as seen in FIG. 7, the hole in pin end 12 of swing arm 22 is slightly larger in diameter than the diameter of pin 14 so that swing arm 22 can freely rotate about pin 14. The holes in terminal ends 13*a* and 13*b* and the hole in pin end 12 are positioned in alignment to form a continuous hole into which pivot pin 14 is inserted to thereby rotatably connect swing arm 22 to plate arms 6*b* and 7*b*.

Swing arm 22, stationary arm 8 and cheek plates 6*a* and 7*a* combine to form the restraining space in closed ring 9. Accordingly, as shown in FIG. 1, swing arm 22 rotates around pivot pin 14 and inwardly into proximal end 3 to form the restraining space with stationary arm 8.

As seen in FIG. 2, the distance from outer edge 18 to inner edge 17 of pin end 12 is substantially constant. However, the distance from outer edge 16 to inner edge 19 of free end 10 is not constant. In this regard, the distance from outer edge 16 to inner edge 19 of free end 10 diminishes from a maximum value at point 21 of outer edge 16 to a minimum value at point 23 of outer edge 16. The difference in the width of free end 10 from point 21 to point 23, as just mentioned, is caused by the fact that the radial distance from the center of pin 14 to outer edge 16 between points 21 and 23 is constant. The reason for this constant radial distance shall become more clear herein below. Outer edge 16 is equipped with a multiplicity of gear teeth 16*a* between points 21 and 23.

Figure 9:
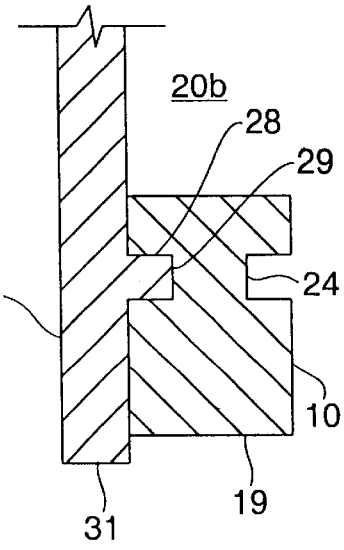
FIG. 9 is a partial sectional view taken in the direction of cut line 9—9 of FIG. 2 showing the operating relationship between the swing arm and the cheek plates.

Edge 29 of cheek plate 6*a* and edge 31 of cheek plate 7*a* each extend beyond housing block 20 adjacent closed ring 9 by an amount sufficient to at least be in alignment with inner edge 19 of free end 10 of swing arm 22. As seen in FIGS. 1, 2 and 9, edges 29 and 31 and side 20*a* of housing block 20 adjacent to closed ring 9 form slot 20*b* into which free end 10 is rotated. Slot 20*b* covers and protects gear teeth 16*a* when handcuff 2 is in the closed position to thereby form closed ring 9.

Referring now to FIG. 9, free end 10 of swing arm 22 is shown to have curvilinear groove 24 cut in one surface of free end 10 adjacent to outer edge 16. Curvilinear groove 28 is cut in the reverse surface of free end 10 and is in alignment with groove 24. Each of grooves 24 and 28 are concentric to the curve of outer edge 16 of free end 10. The nominal radii of each of grooves 24 and 28 are equal to each other but are less than the radial distance from pin 14 to edge 16. It is understood that the radii of the curvilinear grooves 24 and 28 are measured from the center of pivot pin 14.

The inner surfaces of cheek plates 6*a* and 7*a* adjacent to closed ring 9 each have a raised continuous ridge or boss formed thereon. Note boss 29 on cheek plate 7*a*. The boss on cheek plate 6*a* is not shown. Each boss is curvilinear in shape and is adapted to be slidably inserted into grooves 28 and 24, respectively. Each boss continuously extends at least from the linear outer edge of cavity 103 on side 50 of block 20 to the linear outer edge of cavity 101 on side 52 of housing block 20.

The bosses on plates 6*a* and 7*a* cooperate with grooves 24 and 28 to guide free end 10 of swing arm 22 into and out of slot 20*b* and to stabilize free end 10 in slot 20*b* so that the teeth 16*a* on free end 10 and the teeth of gears 102 and 104, described below, remain in contact and intermeshed.

The combination of the described grooves and bosses, in view of the extension of the bosses beyond the limits of the indicated cavities in housing block 20 which contain the operating mechanism of this invention, act to block the insertion of any wedge or lever device into the cavities by way of slot 20*b*.

Figure 8:
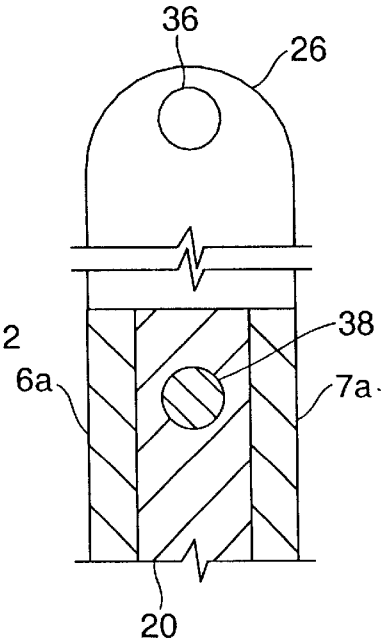
FIG. 8 is a partial sectional view taken in the direction of cut line 8—8 of FIG. 1 showing a connection between each handcuff in a set of handcuffs.

Referring to FIG. 8, the connection of handcuff 2 and handcuff 4 is illustrated by reference to coupling link 26 having hole 36 drilled through one end thereof and another hole 36*a*, not shown, drilled through the other end thereof. The hole in each end of coupling link 26 is aligned with a hole, not shown, drilled in housing block 20 parallel to side 54. The hole in block 20 extends, for example, from open side "B" of cheek plate 6*a* toward arm side "A" of cheek plate 6*a*. The width of each coupling link, such as link 26 as shown in FIGS. 2–4, is adapted to be slidably positioned in aligned slots, such as slot 26*a*, cut in plates 6*a*, 7*a* and block 20. Hole 36*a* is placed in alignment with the hole in block 20. Pin 38 is positioned in the holes drilled in the coupling links and housing block to thereby form a hinged connection between handcuff 2 and handcuff 4. Pin 38 is fixed in block 20, but the holes in the coupling links are adapted to permit the links to rotate around pin 38. The thickness of link 26 is equal to or less than the combined thicknesses of cheek plates 6*a* and 7*a* and block 20 and the distance between holes 36 and 36*a* are selected so that the set of handcuffs can fold to a substantially flat unit. It is believed that the combination of links 25, 26 and 27 cooperate to permit the handcuffs to hinge around an axis lying between handcuffs 2 and 4, but prevent any other movement of one handcuff relative to the other. Accordingly, one handcuff cannot be manipulated to act as a lever to break the hinge end of the other.

Particular attention is now invited to FIGS. 2–4. Observe that housing block 20 is a solid material having cavities formed therein, wherein the outer boundaries of block 20 include swing arm side 50, stationary arm side 52, coupling link side 54 and gear side 20*a*. Swing arm side 50 is substantially perpendicular to coupling link side 54. Gear side 20a is curvilinear in shape, wherein the curve of side 20*a* from point ²1*a* to point 23*a* is concentric to the curve of free end 10 of swing arm 22. In this regard, the curve of side 20*a* is generated by a radius, extending from the center of pin 14, which is greater than the radius which extends from pin 14 to generate the curve of free end 10 from point 21 to point 23. Side 20*a* is, thus, adapted to permit the slidable insertion and removal of free end 10 into and out of slot 20*b* of handcuff 2. It is clear that side 20a intersects side 50 at point 21*a* at an acute angle.

Stationary arm side 52 of block 20 is a compound curve substantially in the shape of the letter "S." In this regard, side 52 curves inwardly to join coupling link side 54 in a substantially perpendicular manner, but curves outwardly to conform with the curved shape of plate arm 7*b*. Side 20*a* intersects side 52 at point 23*a* to form an acute angle.

The operating mechanism of this invention is located in housing block 20. The operating mechanism is broadly comprised of an array of gears 102,104 and 106, control pin 108, and control pin spring 118.

Gears 102 and 104, specifically referred to herein as working gears, and idler gear 106, are positioned in cavities 101, 103 and 105, respectively. Control pin 108 is principally positioned in cavity 111 and control pin spring 118 is positioned in cavity 109. The locking mechanism of this invention is positioned in cavity 107. Cavity 101 joins cavity 105 to enable gear 102 to contact gear 106. Cavity 105 joins cavity 103 to enable gear 106 to contact gear 104. In the case of FIGS. 2–4, cavity 111 joins cavity 101 to enable the proximal end of pin 108 to contact gear 102. (In the case of FIG. 13, cavity 511 joins cavity 505 to enable the proximal end of pin 508 to contact gear 506.) Cavity 111 joins cavity 109. The distal end of pin 108 is placed in cavity 109 to enable the distal end of pin 108 to contact spring 118. Cavity 111 joins cavity 107 to enable contact between control pin 108 and the locking mechanism of this invention. Cavities 101 and 103 join slot 20*b* to enable gears 102 and 104 to contact teeth 16*a* of free end 10 of swing arm 22.

The diameters of working gears 102 and 104 and the diameter of idler gear 106 are, preferably, identical wherein the number of teeth on each such gear is equal to the number of teeth on each of the other gears.

Idler gear 106 rotates in cavity 105 around gear axle 30 which is perpendicularly and transversely fixed in aligned holes 30a and 30*b* drilled into cheek plates 6*a* and 7*a*, respectively. Axle 30 is press fit into holes 30*a* and 30*b* so that axle 30 will not move. Idler gear 106, however, is sized to rotate around axle 30. The positioning of axle 30 enables idler gear 106 to rotate in a plane parallel to the planes of cheek plates 6*a* and 7*a*. Working gear 102 and working gear 104 rotate in cavities 101 and 103 around axles 32 and 34, respectively. Like axle 30, axles 32 and 34 are perpendicularly and transversely fixed in aligned holes 32*a* and 32*b* and 34*a* and 34*b* drilled in cheek plates 6*a* and 7*a*. Axles 32 and 34 are press fit into holes 32*a* and 32*b* and 34*a* and 34*b*, respectively, so that the axles will not move in the holes. Working gears 102 and 104, however, are sized to rotate around axles 32 and 34. The positioning of axles 32 and 34 enables working gears 102 and 104 to rotate in a plane parallel to the planes of cheek plates 6*a* and 7*a*. It is preferred that gears 102, 104 and 106 all rotate in the same plane.

Each of gears 102, 104 and 106 are wheels equipped with teeth mounted on the outer edges thereof. Each gear has the same number of teeth which are sized to contact and intermesh without restriction upon rotation of the gears around the mentioned axles. Furthermore, the teeth of gears 102 and 104 and teeth 16*a* of swing arm 22 are sized to contact and intermesh without restriction whenever swing arm 22 moves inwardly into or outwardly from slot 20*b* of handcuff 2.

Axles 30, 32 and 34 are placed in cavities 105, 101 and 103, respectively, in positions designed to enable the teeth of idler gear 106 to simultaneously contact and intermesh with the teeth of working gears 102 and 104 and to enable the teeth of working gears 102 and 104 to also simultaneously contact and intermesh with teeth 16*a* of swing arm 22.

Observe FIGS. 2–4 and notice, to enable the contact and intermeshing of the teeth of gears 102, 104 and 106 and the teeth 16*a* on swing arm 22, that the diameters of cavities 101, 103 and 105 are greater than the diameters of gears 102, 104 and 106; that cavity 101 intersects cavity 105 and side 20*a*; and that cavity 103 also intersects cavity 105 and side 20*a*. Notice further that the outer sides of cavities 101 and 103 are not curvilinear.

The teeth of gears 102 and 104 penetrate slot 20*b* as the gears rotate in their respective cavities so that at least one tooth of at least one gear is always in contact with at least one tooth of the swing arm whenever the swing arm is either entering or exiting slot 20*b* of handcuff 2. Accordingly, the operation of this invention requires that the operating mechanism be comprised of at least one gear and that at least one tooth of that at least one gear contact and intermesh with at least one tooth 16*a* of swing arm 22. It is preferred that at least one tooth of working gear 102 contact and intermesh with at least one tooth of idler gear 106 and at least one tooth 16*a* of swing arm 22. It is further preferred that at least one tooth of working gear 104 also contact and intermesh with at least one tooth of idler gear 106 and at least one tooth 16*a* of swing arm 22. To obtain at least four points of simultaneous contact as shown in FIGS. 2–4 and 13 it is important that the array of gears be positioned as shown and disclosed to provide such contact.

The operating mechanism of this invention, in addition to being comprised of at least one gear having teeth in operable combination with the teeth of swing arm 22, also comprises a gear rotation control assembly comprised of control pin 108 and control spring 118.

Control pin 108 operates in combination with the teeth of at least one gear to control the rotation of the said at least one gear and, therefor, of the array of gears as shown in FIGS. 2–4. Referring to FIGS. 3, 4, 5, 6 and 12, control pin 108 comprises a linear rod slidably maintained in two rectangular slots defined by cheek plates 6*a* and 7*a* and cavities 109 and 111 in housing block 20. The rod is supported by, and parallel to, cheek plates 6*a* and 7*a*. The linear rod is positioned to oppose working gear 102 to enable the proximal end 108*a* of the rod to contact the teeth of gear 102. (In the case of FIG. 13, the linear-rod is positioned to oppose idler gear 506 to enable the proximal end 508*a* of the rod to contact the teeth of gear 506.) The linear rod is preferably perpendicular to gear axle 32. (In the case of FIG. 13, the linear rod is preferably perpendicular to gear axle 430.)

The combination of cheek plates 6*a* and 7*a* and cavity 111 and the combination of cheek plates 6*a* and 7*a* and cavity 109 define two separate rectangular cross sections. Accordingly, the linear rod of control pin 108 also has two rectangular cross sections. It is believed that the rectangular cross sections of the rod, confined as it is within the defined rectangular cross sections, stabilizes the rod and prevents it from rotating about its linear axis. The reason for the anti rotation feature of the linear rod will become apparent below. Other structures for preventing rotation of the rod in cavity 111 are within the skill of the art.

The rod consists of shaft 108*b* which separates proximal end 108*a* and distal end 108*c*. Proximal end 108*a* of the linear rod of control pin 108, by operation of the invention, as shown in FIG. 4, can be caused to move into cavity 101 and maintain contact with the teeth of working gear 102 and, as shown in FIG. 2, can be caused to remain in cavity 111 to prevent contact with the teeth of working gear 102. (In the case of FIG. 13, proximal end 508*a* of the linear rod of control pin 508 can be caused to move into cavity 505.) As seen in FIG. 3, the cross section of the tip of proximal end 108*a* is in the shape of a wedge having a slanted side and a flat side, wherein the slanted side of the wedge, as shown, faces in the direction of the teeth of swing arm 22 and the flat side of the wedge, as shown, faces in the direction of coupling links 25, 26 and 27. It is further seen in FIG. 3, that the angle of the wedge is adapted to enable the wedge to fit in the valley or space between immediately adjacent teeth in gear 102. (In the case of FIG. 13, the slanted side of the of the wedge faces away from the teeth of the swing arm.) It is apparent that the slanted side of the wedge faces the teeth of the designated gear as the gear rotates in the closing direction.

Distal end 108*c* of the linear rod of control pin 108 is adapted to linearly abut spring 118. Spring 118, acting on distal end 108*c*, functions to urge the rod, and ultimately proximal end 108*a*, into contact with the teeth of gear 102 (gear 506 in FIG. 13). As shown in FIG. 3, control spring 118 and distal end 108*c* are positioned in cavity 109. The width of cavity 109 is greater than the width of cavity 111. A shoulder is, thus, produced in housing 20 at the intersection of cavity 109 and 111. The width of distal end 108*c* is greater than width of the slot which slidably supports shaft 108*b*. Accordingly, the linear movement of control pin 108 toward gear 102 is controlled by the shoulder at the intersection of cavities 109 and 111 which acts against distal end 108*c* to limit the movement of control pin 108.

In the closing position, as shown in FIG. 3, contact between distal end 108*c* and the mentioned shoulder between cavities 109 and 111 and the movement of proximal end 108*a* toward gear 102 (gear 506 in FIG. 13) is prevented by the contact between lever 110 and leg 212. In the locked position, as shown in FIG. 4, contact between lever 110 and leg 211 prevents distal end 108*c* from moving away from gear 102 (gear 506 in FIG. 13), however distal end 108*c* is permitted to contact, or at least to more closely approach, the mentioned shoulder between cavities 109 and 111.

In operation, when swing arm 22 enters slot 20*b* to close the restraining space, gears 102,104 and 106 begin to rotate as soon as teeth 16*a* on swing arm 22 contacts gear 104. It is clear, that the rotation of swing arm 22 in one direction, causes gears 102 and 104 to rotate in the opposite direction which in turn causes gear 106 to rotate in the same direction as swing arm 22. It is equally clear, that gear 102 (gear 506 in FIG. 13), in order to rotate at all, must rotate past proximal end 108*a* which, therefor, requires distal end 108*c* to move linearly against and compress spring 118. The wedge shape of proximal end 108*a* permits a tooth of gear 102 (gear 506 in FIG. 13), while moving in the closing rotational direction, which in the specific example of FIG. 3 is clockwise, (counter clockwise in FIG. 13) to rotate against the slanted side (and away from the flat side) of the wedge. It is believed that the slanted side of the wedge operates to convert the closing rotational motion of the tooth into a linear motion which acts to compress spring 118 with the result that the pushing tooth slides past the proximal end 108*a* which causes proximal end 108*a* to clear the pushing tooth. At the point of clearance spring 118 linearly expands to cause proximal end 108*a* to immediately enter the valley between the pushing tooth and the next tooth in succession. The action just described is then repeated.

It is believed that the slanted side of the wedge will operate more efficiently if the slant is in fact concave as shown in FIG. 3. Accordingly, in a preferred embodiment, the slanted side of the wedge is concave.

It is clearly important to the operation of the invention that the slanted side of the wedge be in contact with a tooth rotating in the closing direction. Thus, linear rotation of control pin 108 in cavity 111 would interrupt the required contact. The above described rectangular cross sections of control pin 108 in the disclosed rectangular slots prevents the linear rotation of control pin 108.

The opening rotational directions of the swing arm and the gears are all opposite to the disclosed closing rotational directions. Thus, the restraining space cannot be opened when the handcuff is configured as shown in FIG. 3 because a tooth of gear 102 (gear 506 in FIG. 13) moving in the opening rotational direction contacts the flat side of the wedge and a linear motion is not produced in control pin 108 to compress spring 118. Accordingly, proximal end 108*a* does not move and swing arm 22 does not move.

To open the restraining space, the handcuff must be configured as shown in FIG. 2 wherein control spring 118 is compressed by operation of the locking mechanism of this invention to linearly further move distal end 108*c* into cavity 109 and to linearly move proximal end 108*a* out of cavity 101 (cavity 505 in FIG. 13) and into cavity 111 to a position where it cannot contact any tooth of gear 102 (gear 506 in FIG. 13). It is to be understood that placing the handcuff in the opening position shown in FIG. 2 enables movement of the gears and swing arm in any rotational direction. However, the gears must rotate to enable swing arm 22 to move in any direction.

To prevent any rotation of the gears in any direction the locking mechanism is configured in the locked position as shown in FIG. 4. It is to be understood that the swing arm, if not engaged with a tooth of a gear as shown in FIG. 4, can move until it contacts a gear tooth, then it cannot move. The locked position, as shown in FIG. 4, resists any force placed by a tooth of gear 102 (gear 506 in FIG. 13) moving in the closing rotational direction on the slant side of the wedge of proximal end 108*a* to compress spring 118.

Referring now to FIGS. 2–5, the locking mechanism of this invention, shown in cavity 107 of housing block 20, is comprised of lever 110, yoke 204, yoke axle 205 and detent assembly 206.

Yoke 204 is in the shape of an oval plate having a closed end and an open end. The closed end, which is pierced by hole 210, is referred to as the axle end of yoke 204. The open end is linearly spaced apart from the closed end. The open end, referred to as the forked end of yoke 204, has first leg 211 on one side of opening 213 and second leg 212 on the opposite side of opening 213 wherein second leg 212 is spaced apart from and, preferably, parallel to first leg 211.

Yoke 204 contains two semi-circular grooves 207 and 208 on the outer edge of the axle end. The position and size of each of grooves 207 and 208, referred to herein as scallops, are significant and shall be further discussed herein below.

Yoke 204 further contains three linear pockets 214, 215 and 216 formed on the surface of hole 210. Each of pockets 214, 215 and 216 is parallel to the axis and spaced at 120° intervals around the surface of hole 210. There must be at least one linear pocket. Multiple pockets can be spaced at intervals greater or less than the mentioned 120° intervals.

Hole 210 of yoke 204 is rotatably mounted on yoke axle 205 which is perpendicularly fixed to cheek plate 7*a*. In this regard, axle 205 press fits in hole 217 in cheek plate 7*a* and yoke 204 rotates around axle 205 in a plane parallel to cheek plates 6*a* and 7*a*. It is understood that axle 205 is fixed and does not rotate in hole 217.

Lever 110 is a rod which is perpendicularly and rigidly attached to shaft 108*b* of control pin 108 at a point intermediate proximal end 108*a* and distal end 108*c*. Lever 110 projects into cavity 107 and opening 213 of yoke 204 between first leg 211, on one side of opening 213, and second leg 212, on the opposite side of opening 213. The respective lengths of lever 110, leg 211 and leg 212 are adjusted to enable leg 211 to contact lever 110 upon rotation of yoke 204 around axle 205 toward proximal end 108*a*, as shown in FIG. 4, and to enable leg 212 to contact lever 110 upon rotation of yoke 204 around axle 205 toward distal end 108*c*, as shown in FIG. 2.

Referring to FIGS. 2, 3, 4 and 5, detent assembly 206 controls the position of yoke 204 relative to axle 205 in cavity 107. Assembly 206, comprised of spring 218 and detent ball 219, is housed in notch 107*a* in housing block 20. Notch 107*a* opens into cavity 107 at a point adjacent to the axle end of yoke 204. One end of spring 218, is in linear contact with block 20 at the end of notch 107*a*, the other end of spring 218 is in linear contact with the exterior surface of ball 219, which extends into cavity 107 and contacts the axle end of yoke 204. Compressive forces developed in spring 218 between housing block 20 in notch 107*a* and the axle end of yoke 204 in cavity 107 act to maintain detent assembly 206 in place.

As mentioned, one end of spring 218 is in linear contact with the exterior surface of ball 219. The outside diameter of spring 218 is less than the diameter of ball 219, accordingly, spring 218 does not envelop ball 219, but merely exerts a biasing force against ball 219. Detent ball 219 is equipped with radial projection 220 whose diameter is, less than the inside diameter of spring 218. Projection 220 is slidably inserted into the interior of spring 218 to help maintain the contact between the exterior surface of ball 219 and spring 218.

The position and size of each of scallops 207 and 208 (in FIG. 13 the scallops are reversed) on the outer edge of the axle end of yoke 204 was earlier mentioned to be of significance. In this regard, each of scallops 207 and 208 are elongated, curved, surfaces which are sized to receive and hold at least a portion of the curved surface of ball 219. Furthermore, scallop 207 is positioned on yoke 204 so that yoke 204 is placed in the opening position, as shown in FIG. 3, when ball 219 is held in scallop 207. Still further, scallop 208 is positioned on yoke 204 so that yoke 204 is placed in the locked position, as shown in FIG. 4, when ball 219 is held in scallop 208.

Figure 12:
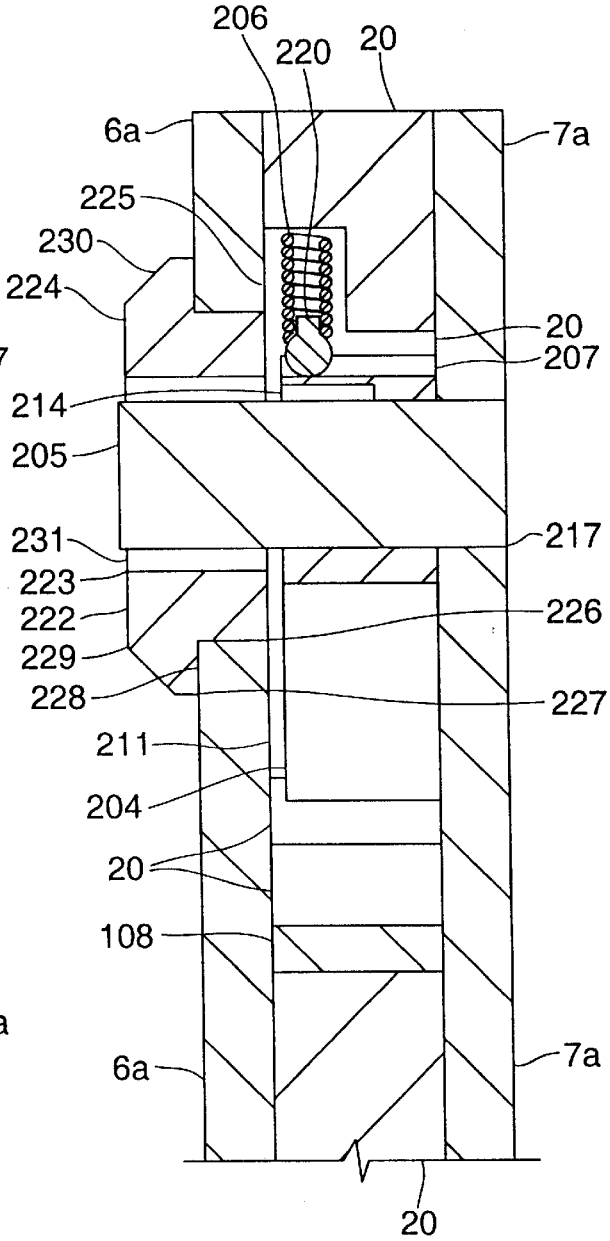
FIG. 12 a partial sectional view taken in the direction of cut line 12—12 of FIG. 1 showing the relationship between the key guide for the key shown in FIG. 1*a* and the locking mechanism shown in FIG. 5.
Figure 10:
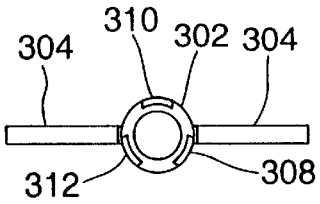
FIG. 10 is an end view of the key of FIG. 1*a*.
Figure 11:
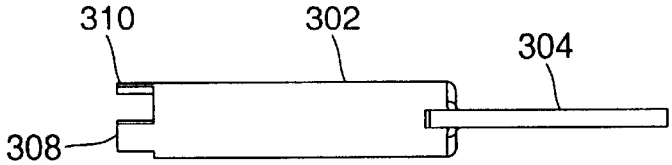
FIG. 11 is a side view the of key of Figure 1*a*.
Figure 6:
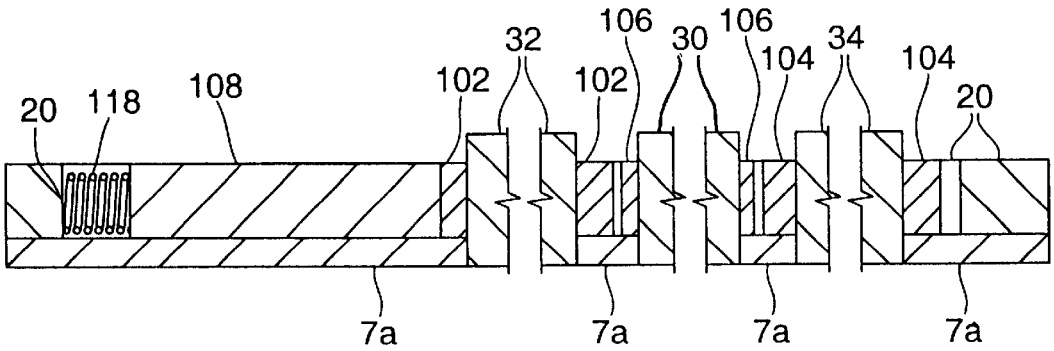
FIG. 6 is a sectional view taken in the direction of cut line 6—6 of FIG. 4 showing the control pin and the operating relationship of the control pin and the gears of this invention.

Keyway 222, shown in FIGS. 1 and 12, is a hollow, cylindrical structure having an interior axial hole 223 drilled from top surface 224 to bottom surface 225, wherein the diameter of hole 223 is greater than the diameter of yoke axle 205. Keyway 222 has a first exterior diameter 226 and a second exterior diameter 227 which is greater than diameter 226. Exterior diameter 226, which is the diameter of bottom surface 225, extends from bottom surface 225 to a position intermediate bottom surface 225 and top surface 224. Shoulder 228 is formed in keyway 222 where diameter 226 ends and diameter 227 begins. The distance from bottom surface 225 to shoulder 228 is preferably equal to the thickness of cheek plate 6*a*. Diameter 229 of top surface 224 is greater than the diameter of axial hole 223 and, preferably, less than exterior diameter 227. The distance from top surface 224 to shoulder 228 is a matter of personal preference. Beveled surface 230 extends from surface 224 to a point on the surface generated by diameter 227 above shoulder 228. The length of surface 230 is a matter of personal preference.

Keyway 222 is supported on the outside surface of cheek plate 6*a*. In this connection, yoke axle 205 extends through axial hole 223. The cylindrical portion of keyway 222 having exterior diameter 226 is pressed into a hole in cheek plate 6*a*, the diameter of which is approximately equal to exterior diameter 226 until shoulder 228 contacts the exterior surface of cheek plate 6*a*. An annulus space 231 is created between the exterior curved surface of yoke axle 205 and the surface of axial hole 223.

The rotation of yoke 204 around yoke axle 205 is effected by use of key 300. Referring to FIGS. 1, 4, 10, 11 and 12, key 300 is comprised of barrel 302 and handle 304. Barrel 302 is a hollow cylinder having an inside diameter greater than the diameter of yoke axle 205 and an outside diameter less than the diameter of hole 223 in keyway 222. The thickness of barrel 302 is, thus, less than the width of annulus space 231 between the exterior curved surface of yoke axle 205 and the surface of axial hole 223.

Barrel 302 has a handle end and a tang end. Handle 304 is rigidly connected to the handle end of barrel 302. As shown in FIG. 1, handle 304 is a disc which is radially connected to and aligned with the linear axis of barrel 302. The particular shape of handle 304 is a matter of personal preference, but it must be of a size sufficient to enable it to be firmly grasped between the thumb and index finger of an adult person. Also as shown in FIG. 1, handle 304 is pierced by hole 306. Hole 306 can be employed by the user as a means of fastening key 300 to a suitable ring or lanyard.

The tang end of barrel 302 is equipped with three elongated tangs 308, 310 and 312 which are rigidly attached to and linearly extend from the tang end of barrel 302 parallel to the linear axis of barrel 302. Each of tangs 308, 310 and 312 are appropriately spaced around barrel 302 to place them in simultaneous alignment with pockets 214, 215 and 216 formed on the surface of hole 210 in yoke 204 and are adapted and shaped to be slidably inserted into pockets 214, 215 and 216.

Barrel 302 must be of length at least sufficient to enable yoke axle 205 to fit within the hollow interior of barrel 302 and tangs 308, 310 and 312 to fit within pockets 214, 215 and 216.

Operation of the Invention

The basic operation and cooperation of the various elements of the operating mechanism and the locking mechanism of this invention has been discussed. It is left to be stated that the tangs of key 300 are placed in the pockets of yoke 204. Key 300 is then turned with a force sufficient to cause pin 108, via lever 110 and leg 212, to overcome the biasing effects of spring 118 in cavity 109 and spring 218 in notch 107*a* to move ball 219 to scallop 207 to thereby place handcuff 2 in closing position as shown in FIG. 3. At that point, free end 10 of swing arm 22 is rotated with sufficient force into slot 20*b* to compress spring 118 to cause teeth 16*a* to at least engage the teeth of gear 104 and preferably the teeth of gears 104 and 102.

Thereafter, with the tangs of key 300 in the pockets of yoke 204, key 300 is turned with a force sufficient to cause pin 108, via lever 110 and leg 211, to overcome the biasing effects of spring 218 in notch 107*a* to move ball 219 to scallop 208 to thereby place handcuff 2 in locked position as shown in FIG. 4.

Thereafter, with the tangs of key 300 in the pockets of yoke 204, key 300 is turned with a force sufficient to cause pin 108, via lever 110 and leg 212, to overcome the biasing effects of spring 118 in cavity 109 and spring 218 in notch 107*a* to move ball 219 past scallops 208 and 207 to a position on the edge of the axle end of yoke 204 to thereby place handcuff 2 in opening position as shown in FIG. 2. Then, while using key 300 to maintain the opening position, free end 10 of swing arm 22,is rotated out of slot 20*b* to a point that no tooth 16*a* on swing arm 22 is in contact with any tooth on gear 104.

Having described the invention that which is claimed is:

1. A handcuff having an operating mechanism comprised of a planar base, a first working gear, an idler gear, a control pin and a swing arm;

said planar base having perpendicularly attached thereto a first gear axle, an idler gear axle and a swing arm axle, wherein said swing arm axle is positioned on said planar base a first fixed distance from said first gear axle, and said idler gear is positioned on said planar base a second fixed distance from said first gear axle, and a third fixed distance from said swing arm axle;

said first working gear is rotatably mounted on said first gear axle to enable said first working gear to rotate around said first gear axle in a plane parallel to the plane of said planar base, wherein said first working gear is a wheel having a first radius and teeth mounted oh the outer edge thereof;

said swing arm is rotatably mounted on said swing arm axle to enable said swing arm to rotate around said swing arm axle in a plane parallel to the plane of said planar base, wherein said swing arm is a curvilinear member having a second radius and teeth mounted on the outer edge of a first portion thereof, wherein the distance from said outer edge of said first portion of said swing arm to said swing arm axle is said second radius;

said first fixed distance is substantially equal to the sum of the lengths of said second radius and said first radius, whereby said teeth on said first working gear and said teeth on said swing arm are in contact each with the other upon rotation of said swing arm around said swing arm axle, wherein said teeth on said first working gear and said teeth on said swing arm are adapted to intermesh upon said contact;

said idler gear is rotatably mounted on said idler gear axle to enable said idler gear to rotate around said idler gear axle in a plane parallel to the plane of said planar base, wherein said idler gear is a wheel having a third radius and teeth mounted on the outer edge thereof;

said teeth on said idler gear and said teeth on said first working gear are in contact each with the other, wherein said teeth on said idler gear and said teeth on said first working gear are adapted to intermesh upon said contact;

said control pin is comprised of a linear rod slidably mounted on and parallel to said planar base in a position opposed to said idler gear, said linear rod having a proximal end, a distal end and a biasing means abutting said distal end to urge said proximal end into contact with said teeth on said idler gear, wherein said proximal end of said linear rod is adapted to contact said teeth on said idler gear to permit rotation of said idler gear around said idler gear axle in one rotational direction and to prevent rotation of said idler gear around said idler gear axle in the opposite rotational direction, thus permitting rotation of said first working gear around said first gear axle in one direction and to prevent rotation of said first working gear around said first gear axle in the opposite rotational direction.

2. The handcuff of claim 1 wherein said operating mechanism is further comprised of a second gear axle and a second working gear wherein said second gear axle is perpendicularly attached to and positioned on said planar base a fourth fixed distance from said first gear axle, a fifth fixed distance from said swing arm axle and a sixth fixed distance from said idler gear axle;

said second working gear is rotatably mounted on said second gear axle to enable said second working gear to rotate around said second gear axle in a plane parallel to the plane of said planar base, wherein said second working gear is a wheel having a fourth radius and teeth mounted on the outer edge thereof;

said fifth fixed distance is substantially equal to the sum of the lengths of said second radius and said fourth radius whereby said teeth on said second working gear and said teeth on said swing arm are in contact each with the other upon rotation of said swing arm around said swing arm axle, wherein said teeth on said second working gear and said teeth on said swing arm are adapted to intermesh upon said contact.

3. The handcuff of claim 1 wherein said teeth on said idler gear and said teeth on said second working gear are in contact each with the other, wherein said teeth on said idler gear and said teeth on said second working gear are adapted to intermesh upon said contact, said fourth radius is equal to said first radius and said fifth fixed distance is equal to said first fixed distance.

4. The handcuff of claim 3 wherein said third radius is equal to said first radius.

5. The handcuff of claim 4 wherein said linear rod is positioned perpendicular to said idler gear axle.

6. The handcuff of claim 1 further comprising a locking mechanism comprising a linear bar perpendicularly and rigidly attached to said rod intermediate said proximal end and said distal end of said rod, a yoke axle perpendicularly attached to said planar base, and a yoke rotatably connected to said yoke axle;

said yoke is a plate having an axle end and a forked end linearly spaced apart from said axle end, wherein said axle end is closed and rotatably mounted on said yoke axle and said forked end is an opening in said plate defined by a first leg on one side of said opening and a second leg on the opposite side of said opening side, said second leg being spaced apart from said first leg; and said yoke axle is positioned on said planar base so that said linear bar on said rod is situated between said first leg and said second leg of said forked end of said yoke whereby rotation of said yoke around said yoke axle in one rotational direction enables contact between said linear bar and the inside of said first leg to linearly urge said rod against said biasing means at said distal end of said rod and rotation of said yoke around said yoke axle in the opposite rotational direction enables contact between said linear bar and the inside of said second leg to linearly urge said proximal end of said rod against said teeth of said idler gear.

7. The handcuff of claim 6 wherein said operating mechanism is further comprised of a second gear axle and a second working gear wherein said second gear axle is perpendicularly attached to and positioned on said planar base a fourth fixed distance from said first gear axle, a fifth fixed distance from said swing arm axle and a sixth fixed distance from said idler gear axle;

said second working gear is rotatably mounted on said second gear axle to enable said second working gear to rotate around said second gear axle in a plane parallel to the plane of said planar base, wherein said second working gear is a wheel having a fourth radius and teeth mounted on the outer edge thereof;

said fifth fixed distance is substantially equal to the sum of the lengths of said second radius and said fourth radius whereby said teeth on said second working gear and said teeth on said swing arm are in contact each with the other upon rotation of said swing arm around said swing arm axle, wherein said teeth on said second working gear and said teeth on said swing arm are adapted to intermesh upon said contact.

8. The handcuff of claim 6 wherein said teeth on said idler gear and said teeth on said second working gear are in contact each with the other, wherein said teeth on said idler gear and said teeth on said second working gear are adapted to intermesh upon said contact, said fourth radius is equal to said first radius and said fifth fixed distance is equal to said first fixed distance.

9. The handcuff of claim 8 wherein said third radius is equal to said first radius.

10. The handcuff of claim 9 wherein said linear rod is positioned perpendicular to said idler gear axle.

* * * * *